US007960665B2

(12) United States Patent
Sakai et al.

(10) Patent No.: US 7,960,665 B2
(45) Date of Patent: Jun. 14, 2011

(54) PUSHBUTTON SWITCH DEVICE

(75) Inventors: Takayuki Sakai, Osaka (JP); Eiji Yuasa, Tokyo (JP)

(73) Assignees: IDEC Corporation, Osaka-shi (JP); Mitsubishi Electric Corporation, Tokyo (JP)

( * ) Notice: Subject to any disclaimer, the term of this patent is extended or adjusted under 35 U.S.C. 154(b) by 226 days.

(21) Appl. No.: 11/794,627

(22) PCT Filed: Feb. 2, 2006

(86) PCT No.: PCT/JP2006/301750

§ 371 (c)(1),
(2), (4) Date: Jul. 3, 2007

(87) PCT Pub. No.: WO2007/088616

PCT Pub. Date: Aug. 9, 2007

(65) Prior Publication Data

US 2009/0205942 A1 Aug. 20, 2009

(51) Int. Cl.
*H01H 13/70* (2006.01)

(52) U.S. Cl. ..... 200/345

(58) Field of Classification Search ..... 200/345, 200/520, 341

See application file for complete search history.

(56) References Cited

U.S. PATENT DOCUMENTS

| | | | | |
|---|---|---|---|---|
| 3,800,104 | A * | 3/1974 | Lien et al. | 200/5 A |
| 5,345,051 | A * | 9/1994 | Miike | 200/345 |
| 5,941,372 | A * | 8/1999 | Johnston | 200/343 |
| 6,809,278 | B2 * | 10/2004 | Tsubaki | 200/341 |
| 6,858,812 | B2 * | 2/2005 | Sasaki et al. | 200/344 |
| 7,244,898 | B2 * | 7/2007 | Kim | 200/314 |
| 2003/0234169 | A1 * | 12/2003 | Iwakiri | 200/341 |

FOREIGN PATENT DOCUMENTS

| | | |
|---|---|---|
| CN | 1442867 | 9/2003 |
| JP | 60-071033 | 5/1985 |
| JP | 60-71033 | 5/1985 |
| JP | 60-147033 | 9/1985 |
| JP | 63-026928 | 2/1988 |
| JP | 5 266754 | 10/1993 |
| JP | 2003-257278 A | 9/2003 |
| JP | 2004 119238 | 4/2004 |
| KR | 2003-0071625 | 9/2003 |

* cited by examiner

*Primary Examiner* — Edwin A. Leon

*Assistant Examiner* — Vanessa Girardi

(74) *Attorney, Agent, or Firm* — Oblon, Spivak, McClelland, Maier & Neustadt, L.L.P.

(57) ABSTRACT

Provided is a pushbutton switch device provided with a switch case in which a depressing member is arranged which, when moved downwards, depresses a switch. Arranged inside the switch case is an operating member which, when depressed, comes into contact with the depressing member to move the depressing member downwards. Provided in the peripheral edge of the operating member are a plurality of engagement portions to be engaged with the peripheral edge of the switch case. When the operating member is depressed, the depressed portion of the operating member rotates downwardly using, as a fulcrum, the engagement portion corresponding to the depressed portion of the operating member.

13 Claims, 10 Drawing Sheets

PUSHBUTTON SWITCH DEVICE

TECHNICAL FIELD

The present invention relates to a pushbutton switch device in which a switch is arranged in a switch case, the switch being deviated from a central portion toward an end portion thereof, in particular, a pushbutton switch device provided with, for example, a light emitting element being arranged at the central portion of the switch case, which is applicable to an elevator or the like.

BACKGROUND ART

Conventionally, a pushbutton switch device provided with a light emitting element arranged at the center of the interior of a switch case, which is applicable to an elevator, is constructed, for example, as shown in FIG. 15. That is, as shown in FIG. 15, a printed circuit board 3 is arranged on the lower surface of a switch case 1, and a light emitting diode (hereinafter referred to as LED) 5 is mounted on the upper surface of the printed circuit board 3; a reflector 7 having a reflection surface in the form of a truncated-cone-shaped peripheral surface and adapted to upwardly reflect the light of the LED 5 is arranged so as to face substantially the central portion of the switch case 1, and a built-in switch 9 formed of, for example, a tact switch, is mounted on the printed circuit board 3 on the right-hand side of the reflector 7.

Further, an operating member 13 to which a pushbutton 11 is detachably attached is arranged so as to close the upper side of the switch case 1. The pushbutton 11 is depressed to integrally push down the operating member 13, and the operating member 13 thus depressed presses downwardly a switch member 9*a* arranged on the upper surface of the built-in switch 9 through the intermediation of a flexible rubber 15, to thereby turn on the built-in switch 9.

At this time, a left-hand end 13*a* of the operating member 13 is placed on a step portion 17 at the left-hand end of the switch case 1 to be locked to the lower surface of a lock protrusion 19 at the upper left-hand upper of the switch case 1, and a hook-like portion 13*b* integrally formed with the operating member 13 to extend downwardly from the lower surface of the right-hand end portion of the operating member 13 is detachably engaged from below with an engagement portion 21 having an L-shaped sectional configuration at the right-hand end of the switch case 1.

Due to the elasticity of the rubber 15, an upward urging force is imparted to the operating member 13. When the operating member 13 is depressed through depression of the pushbutton 11 against this urging force, the hook-like portion 13*b* at the right-hand end of the operating member 13 rotates downwardly as indicated by the arrow of FIG. 15 using the left-hand end of the operating member 13 as a fulcrum, with the result that the lower surface of the right-hand end portion of the operating member 13 pressurizes the rubber 15 to depress the switch member 9*a* of the built-in switch 9, to thereby turn on the built-in switch 9.

When the depression of the pushbutton 11 is released, the hook-like portion 13*b* at the right-hand end of the operating member 13 rotates upwards due to the elasticity of the rubber 15, and the hook-like portion 13*b* at the right-hand end of the operating member 13 engages with the engagement portion 21 of the switch case 1 again, with the operating member 13 being restored to the former state before the depression.

The urging force exerted on the operating member 13 may also be provided by some other urging means, such as a spring rather than the rubber 15.

In another example of such a pushbutton switch device, when the pushbutton is depressed, one end of the pushbutton abuts an abutment member, and the other end portion of the pushbutton rotates using that one end as a fulcrum, thereby operating the switch (see, for example, Patent Document 1).

In still another example, a pair of support shafts are provided on the lower side of the pushbutton main body, and a double-folded spring member is locked to both support shafts; the depressing operation on the switch is effected by the fold-back piece of the spring member; at this time, whichever portion of the pushbutton main body may be depressed, the pushbutton main body is pushed down using a portion of the fold-backpiece as a fulcrum (see, for example, Patent Document 2).

Patent Document 1: JP 2004-119238 A (paragraph 0012, FIG. 12)

Patent Document 2: JP 05-266754 A (paragraphs 0022, 0023, FIGS. 8, 9)

DISCLOSURE OF THE INVENTION

Problem to be Solved by the Invention

However, in these conventional pushbutton switches, only one fulcrum is used when the pushbutton or the pushbutton main body is depressed, so the distance from the fulcrum to the depressed portion significantly varies depending upon which part of the pushbutton or of the pushbutton main body is depressed. As a result, there is produced a significant difference in operational load between a position far from the fulcrum and a position near the fulcrum, which results in a problem of bringing discomfort to the operator due to the difference in operational load caused by the difference in the position depressed.

The present invention has been made in view of the above problem in the prior art. It is an object of the present invention to attain a substantially uniform operational load regardless of which position of the operating member or the pushbutton is depressed.

Means for Solving the Problem

According to the present invention, there is provided a pushbutton switch including a switch deviated from a central portion of a switch case toward an end portion side thereof, characterized by including: a depressing member which is arranged in the switch case so as to be vertically movable and urged upwardly for depressing the switch when moved downwards; and an operating member which is arranged above the depressing member in the switch case so as to be vertically movable, the operating member having a plurality of engagement portions engaged with a peripheral edge thereof so as not to be detached from the switch case, and having, substantially at the center of a lower surface thereof, an abutment portion which, when depressed, comes into contact with substantially the center of an upper surface of the depressing member to cause the depressing member to move downwardly against an upward urging force, and in that, when the operating member is depressed, the depressed portion of the operating member rotates downwardly using, as a fulcrum, one of the engagement portions corresponding to the depressed portion.

BEST MODE FOR CARRYING OUT THE INVENTION

Figure 1:
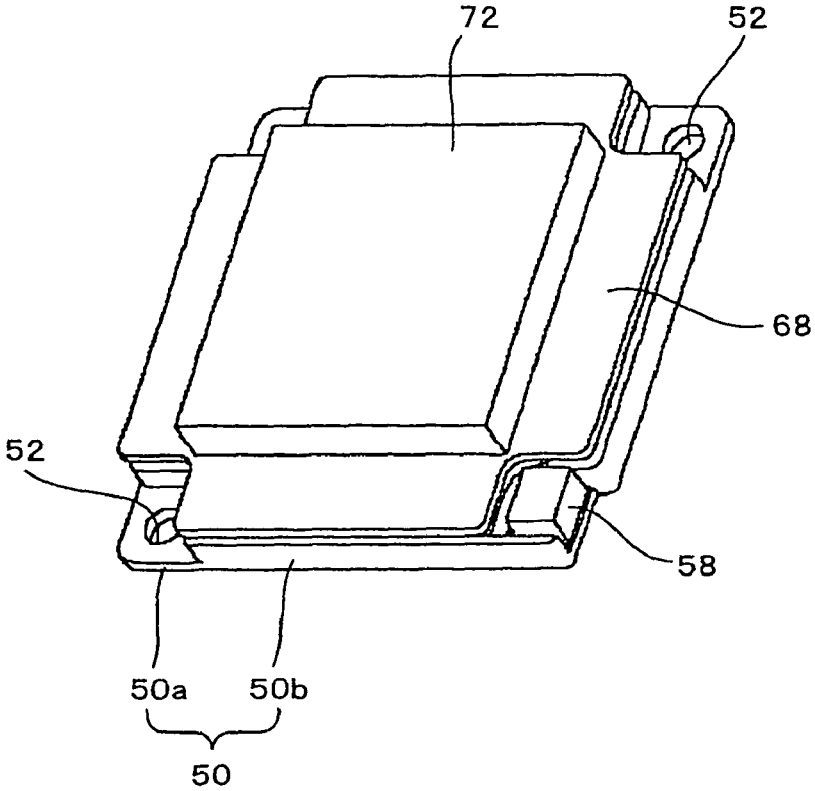
FIG. 1 is an external perspective view of an embodiment of the present invention.
Figure 2:
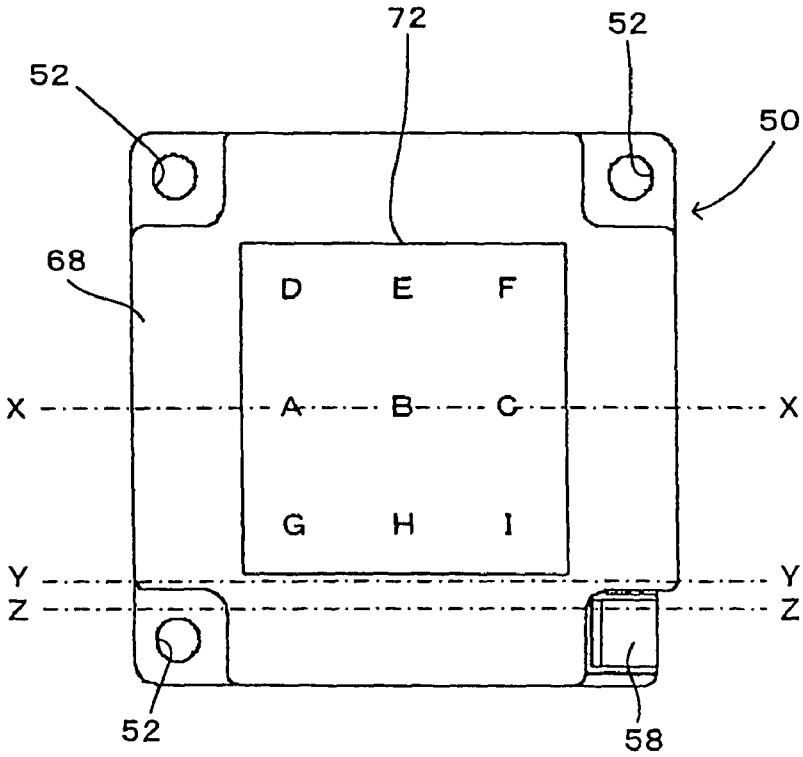
FIG. 2 is a plan view of the embodiment.
Figure 3:
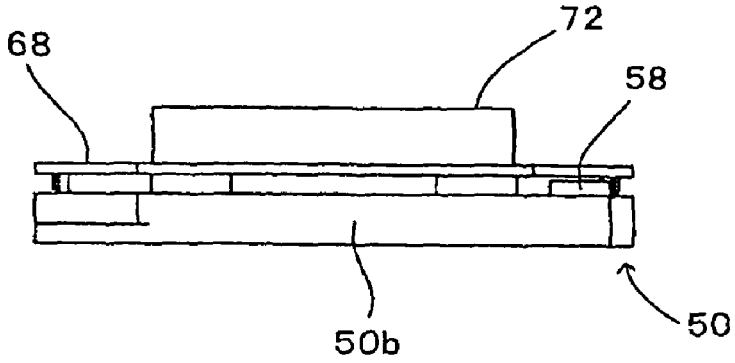
FIG. 3 is a front view of the embodiment.
Figure 4:
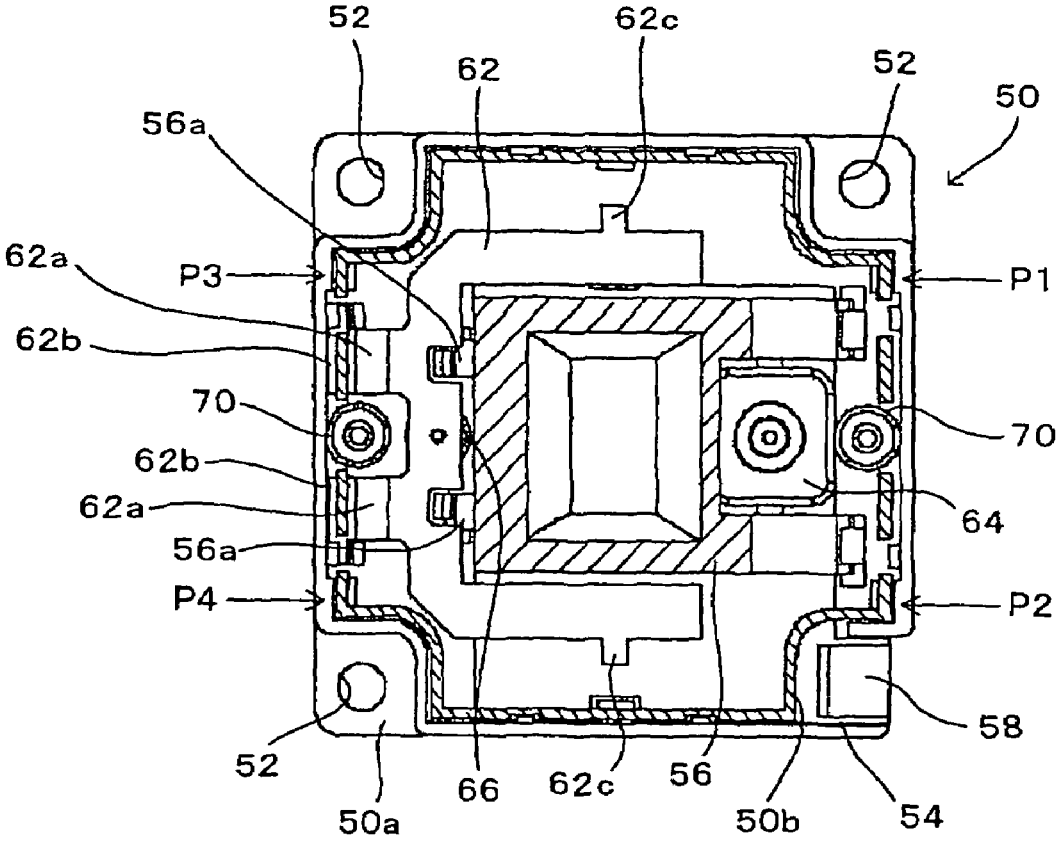
FIG. 4 is a plan sectional view of the inner construction of the embodiment.
Figure 5:
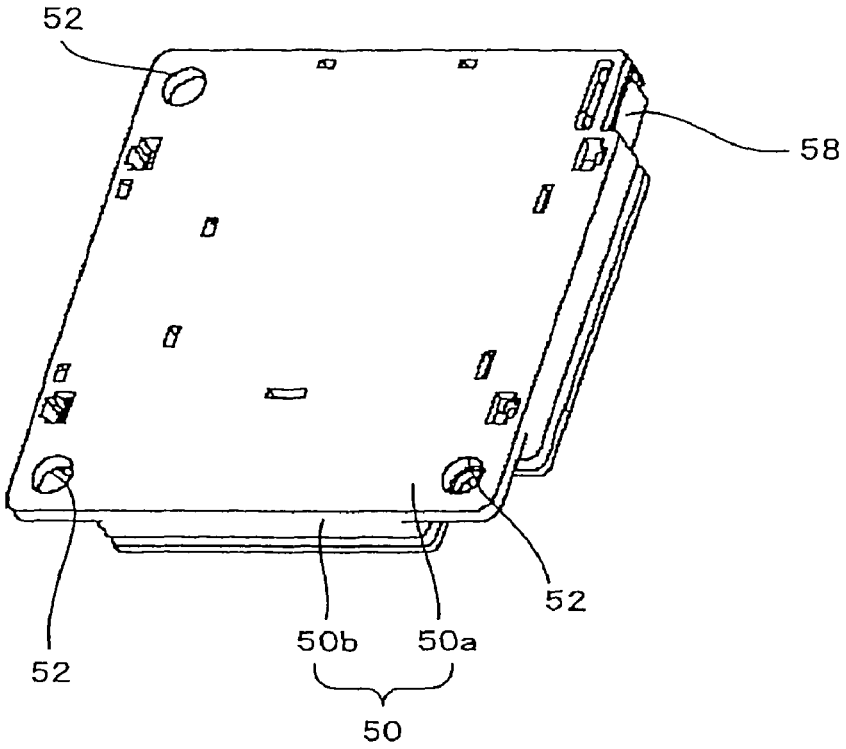
FIG. 5 is a bottom perspective view of the embodiment.
Figure 6:
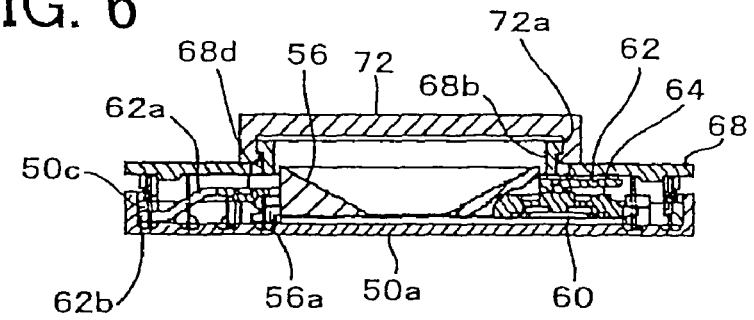
FIG. 6 is a front sectional view taken along the line X-X of FIG. 2.
Figure 7:
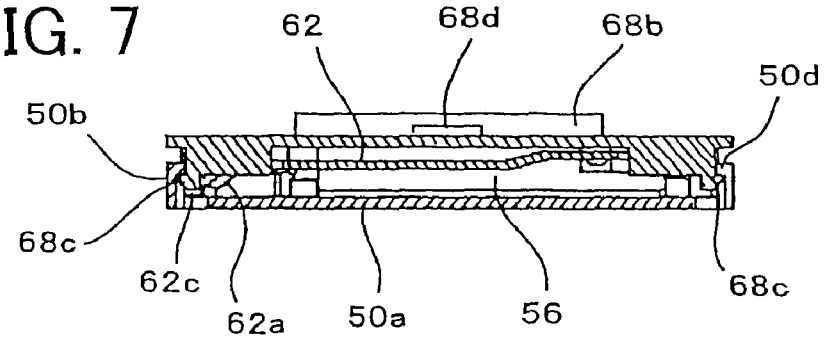
FIG. 7 is a front sectional view taken along the line Y-Y of FIG. 2.
Figure 8:
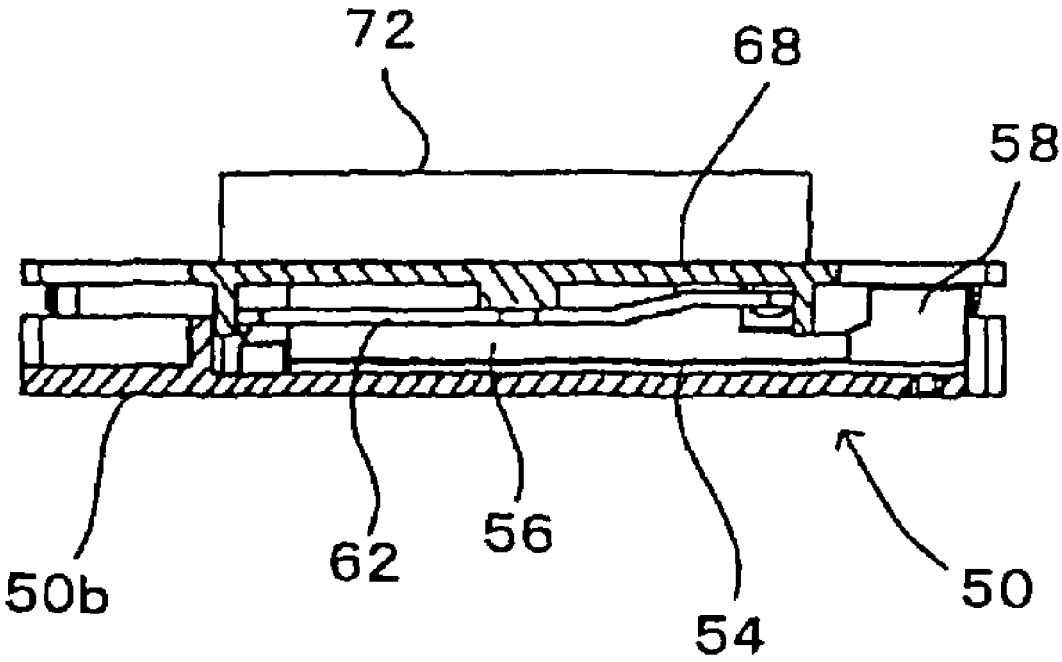
FIG. 8 is a front sectional view taken along the line Z-Z of FIG. 2.
Figure 9:
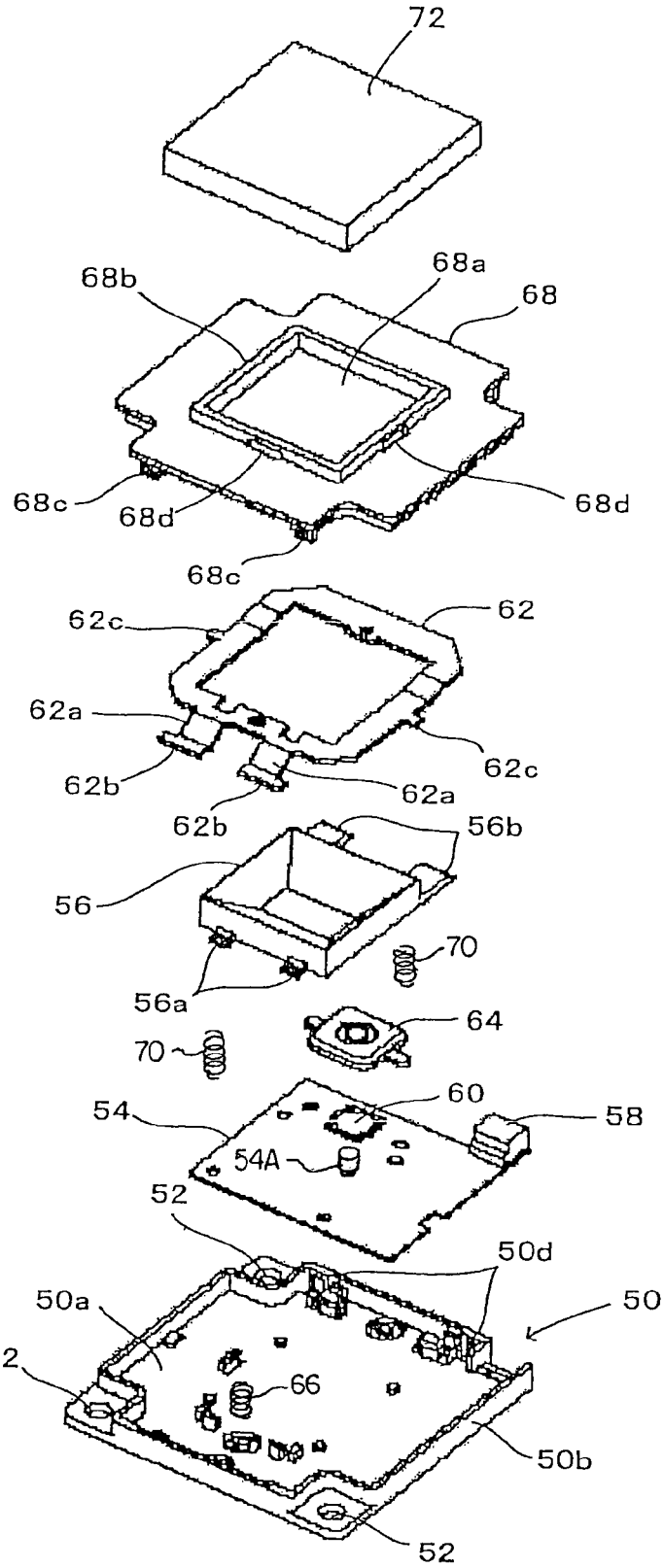
FIG. 9 is an exploded perspective view, as seen obliquely from above, of the embodiment.
Figure 10:
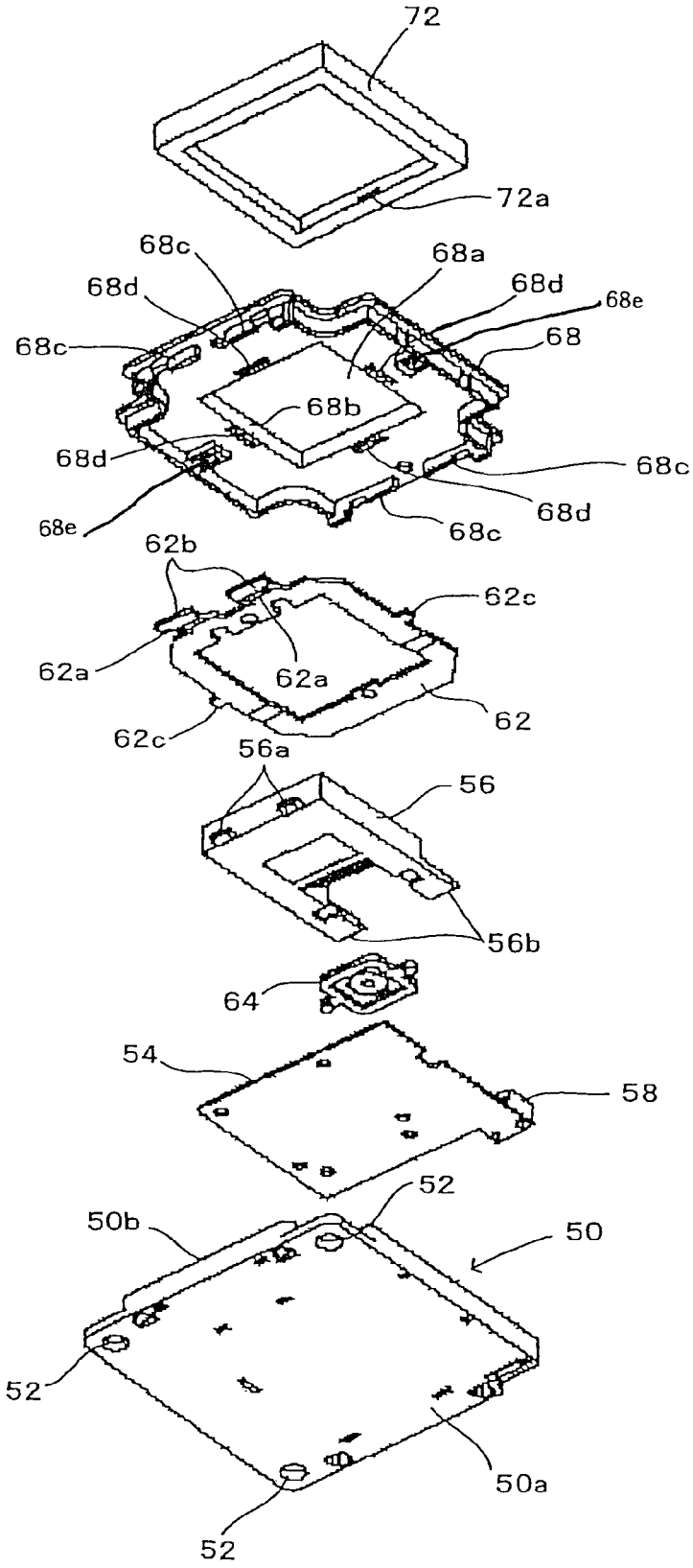
FIG. 10 is an exploded perspective view, as seen obliquely from below, of the embodiment.

In the following, an embodiment of the present invention will be described with reference to FIGS. 1 through 10. FIG. 1 is an external perspective view, FIG. 2 is a plan view, FIG. 3 is a front view, FIG. 4 is a plan sectional view, FIG. 5 is a bottom perspective view, FIG. 6 is a front sectional view taken along the line X-X of FIG. 2, FIG. 7 is a front sectional view taken along the line Y-Y of FIG. 2, FIG. 8 is a front sectional view taken along the line Z-Z of FIG. 2, FIG. 9 is an exploded perspective view as seen obliquely from above, and FIG. 10 is an exploded perspective view as seen obliquely from below.

<Construction>

The pushbutton switch device of this embodiment is constructed as shown in FIGS. 1 through 10. There is provided a resin switch case 50 composed of a flat plate 50*a* substantially rectangular in plan view and a raised plate 50*b* raised along a peripheral edge of the flat plate except for corner portions thereof; bolts are passed through insertion holes 52 provided in the three corner portions of the switch case 50 except for the front right corner, whereby the switch case 50 is secured at a predetermined mounting position.

In an interior of the switch case 50 surrounded by the raised plate 50*b* , there is arranged a printed circuit board 54 on which various circuit elements are mounted. Substantially at a center of the printed circuit board 54, there is mounted a light emitting diode 54A (hereinafter referred to as LED), which is a light emitting element, and a reflector 56 is fixed to the switch case 50 so as to surround the LED; the light emitted from the LED is upwardly reflected by the reflector 56.

A pair of engagement members 56*a* formed integrally at a lower end of a left-hand peripheral surface of the reflector 56, and a pair of engagement members 56*b* formed integrally at a lower end of a left-hand peripheral surface of the reflector 56 and of a configuration different from that of the engagement members 56*a*, are detachably engaged with engagement boss portions integrally formed on an upper surface of the interior surrounded by the raised plate 50*b* of the switch case 50, whereby the reflector 56*b* is detachably fixed in position.

At the corner position of the printed circuit board 54 corresponding to the front right corner portion of the switch case 50, in which no insertion hole 52 is formed, there is mounted a connector 58 for connection to an external lead wire; further, on the printed circuit board 54, there is mounted a tact switch 60, which is arranged on a right-hand side of the reflector 56, with a switch member of the tact switch 60 being situated on an upper surface thereof. In this way, in this embodiment, the tact switch 60 is arranged so as to be deviated to the right-hand end portion side from the central portion of the interior of the switch case 50.

Further, a depressing member 62 in the form of a rectangular frame formed of an elastic metal or the like is arranged so as to surround the reflector 56, and the depressing member 62 has a pair of extending members 62*a* integrally formed on a left-handend portion thereof so as to extend obliquely downwards. At forward ends of the extending members 62*a*, there are formed lock claws 62*b*. A pair of lock protrusions 50*c* are formed on the raised plate 50*b* on the left-hand side of the switch case 50. In a state where lower surfaces of the lock claws 62*b* are in contact with the upper surface of the switch case 50, the two lock claws 62*b* are fitted onto lower sides of the lock protrusions 50*c*, whereby the two lock claws 62*b* are detachably locked to the switch case 50, with a right-hand end portion of the depressing member 62 being vertically movable using the locked portions of the lock claws 62*b* as fulcrums.

At this time, the right-hand end portion of the depressing member 62, which is slightly bent upwards, is upwardly urged by an urging force of a spring 66 serving as an urging member described in detail below. When the right-hand end portion of the depressing member 62 is pushed down against the urging force, a protrusion protruding downwards from the right-hand end portion of the depressing member 62 depresses the switch member of the tact switch 60 through a flexible rubber 64 that is square in plan view, whereby the tact switch 60 is turned on.

On the portion of the upper surface of the switch case 50 situated below the center of the left-hand end portion of the depressing member 62, there is integrally formed a protruding cylindrical boss, and the spring 66 is fitted onto the boss; thus, the spring 66 is provided between the left-hand end portion of the depressing member 62 and the switch case 50, and the urging force of the depressing member 62 is adjusted by the spring 66.

The intermediate portion between the locked lock claws 62*b* of the depressing member 62, the center of the tact switch 60, and the center of the switch case 50 are arranged substantially in the same row as seen in plan view. Due to this arrangement, when the depressing member 62 is depressed, it is possible to make the moment of the depressing member 62 at the time of depression of the tact switch 60 substantially the same regardless of the depressed portion of an operating member described below.

A resin operating body having of a configuration which allows the resin operating body to be fit into the interior surrounded by the raised plate 50*b* of the switch case 50 is arranged on the inner side of the switch case 50, and a square through-hole 68*a* is provided at the center of the operating member 68, and a short square tube portion 68*b* is formed integrally with the operating member 68 so as to extend along the peripheral edge of the through-hole 68*a*.

Further, on the lower surfaces of the left-hand end and the right-hand end portions of the operating member 68, there are respectively formed a pair of outwardly directed engagement claws 68*c*; the engagement claws 68*c* are engaged from below with engagement protrusions 50*d* protruding inwardly from the upper ends of the right and left raised plates 50*b* of the switch case 50, and through the engagement of the engagement claws 68*c* and the engagement protrusions 50*d*, the operating member 68 is arranged in the switch case 50 so as to be vertically movable and so as not to be detached therefrom.

Further, on the portions of the upper surface of the switch case 50 situated below the respective centers of the right-hand and left-hand end portions of the operating member 68, there are integrally formed cylindrical bosses protruding therefrom, and springs 70 serving as other urging members are fitted onto these bosses; thus, the springs 70 are provided between the operating member 68 and the switch case 50 so that the operating member 68 is constantly urged upwards by the two springs 70.

On the front and rear portions of the lower surface of the operating member 68, there are formed abutment portions 68*e*(hereinafter, "abutment portions") adapted to abut abutment members 62*c* integrally formed at the centers of the front and rear end portions of the depressing member 62. When the operating member 68 is depressed against the elastic force of the springs 70, the abutment portions of the operating member 68 abut the abutment members 62*c* of the depressing member 62 to thereby depress the depressing member 62.

A pushbutton 72 formed of a light-transmitting resin or the like and square in plan view is detachably attached so as to cover the outer peripheral surface and the upper surface of the square tube portion 68*b* of the operating member 68. Here, a lock groove 68*d* is formed at the center of the lower portion of the outer side of each peripheral wall of the square tube portion 68*b*, and an elastic protrusion 72*a* capable of being respectively engaged with each lock groove 68*d* is formed at the center of the lower portion of the inner side of each peripheral wall of the push button 72; each lock protrusion 72*a* is detachably locked to each lock groove 68*d*, whereby the pushbutton 72 is detachably attached to the operating member 68.

Through depressing operation of the pushbutton 72, the operating member 68 is integrally depressed with the pushbutton 72. Accordingly, in the following description of the operation, etc., the portion of the pushbutton 72 depressed will be regarded as the same as the portion of the operating member 68 depressed.

<Center Depressing Operation>

When the pushbutton switch device, constructed as described above, is applied, for example, to an elevator switch, and the user depresses the pushbutton 72, the operating member 68 is depressed against the force of the springs 70, and the depressing member 62 is depressed, whereby the tact switch 60 is turned on and the LED is lit, and the lit state of the LED is maintained by a control circuit (not shown) until a predetermined condition is satisfied (e.g., until the elevator door opens), with the lighting of the LED being visible to the user through the pushbutton 72.

Referring to FIG. 2, when a portion B, which is a center of the pushbutton 72, is depressed, the depressing force on the pushbutton 72 is applied to substantially the central portion of the operating member 68. At this time, the operating member 68 uses none of the engagement portions of the engagement claws 68*c* and the engagement protrusions 50*d* as a fulcrum but makes downward parallel movement against the force of the springs 70, with the depressing force on the pushbutton 72 being transmitted as it is to the abutment portions situated near the center of the operating member 68. At this time, the reaction force received by the operating member 68 through the abutment portions is the resultant force of the restoring forces of the springs 70, the depressing member 62, and the spring 66, and this resultant force corresponds to an operational load.

As a result, the depressing member 62 is depressed with the abutment portions of the operating member 68 abutting the abutment members 62*c* of the depressing member 62, and the right-hand end portion of the depressing member 62 is moved downwards using the locked portions of the lock claws 62*b* as fulcrums, whereby the switch member of the tact switch 60 is depressed through the rubber 64, whereby the tact switch 60 is turned on.

<End Depressing Operation>

Next, when a portion A, which is on the left-hand side of the central portion B of the pushbutton 72 shown in FIG. 2, is depressed, the depressing force on the pushbutton 72 is applied to the portion of the operating member 68 near the left-hand end thereof, so, of the two springs 70 upwardly urging the operating member 68, the left-hand spring 70 is compressed harder than the right-hand spring 70, with the result that the left-hand end portion of the operating member 68 moves downwards against the force of the two springs 70 using the engagement portions P1 and P2 of the engagement claws 68*c* and the engagement protrusions 50*d* on the right-hand side as fulcrums.

As a result of the downward movement of the left-hand end portion of the operating member 68, the abutment portions of the operating member 68 abut the abutment members 62*c* of the depressing member 62 to transmit the depressing force to the depressing member 62, and the depressing member 62 is depressed, with the right-hand end portion of the depressing member 62 being moved downwards using the locked portions of the lock claws 62*b* as fulcrums, whereby the switch member of the tact switch 60 is depressed through the rubber 64 and the tact switch 60 is turned on.

When a portion C, which is on the right-hand side of the central portion B of the pushbutton 72 shown in FIG. 2, is depressed, the depressing force on the pushbutton 72 is applied to the portion of the operating member 68 near the right-hand end thereof, so, of the two springs 70 upwardly urging the operating member 68, the right-hand spring 70 is compressed harder than the left-hand spring 70, with the result that the right-hand end portion of the operating member 68 moves downwards against the force of the two springs 70 using the engagement portions P3 and P4 of the engagement claws 68*c* and the engagement protrusions 50*d* on the left-hand side as fulcrums.

As a result of the downward movement of the right-hand end portion of the operating member 68, the abutment portions of the operating member 68 abut the abutment members 62*c* of the depressing member 62 to transmit the depressing force to the depressing member 62, and the depressing member 62 is depressed, with the right-hand end portion of the depressing member 62 being moved downwards using the locked portions of the lock claws 62*b* as fulcrums, whereby the switch member of the tact switch 60 is depressed through the rubber 64 and the tact switch 60 is turned on.

Here, the respective operational loads when the portions A and C of the pushbutton 72 are depressed will be compared with each other. The distance from the portion A, which is the depressed portion, to the fulcrums P1 and P2, is substantially the same as the distance from the portion C, which is the depressed portion, to the fulcrums P3 and P4, and the respective reaction forces received by the operating member 68 when the portions A and C of the pushbutton 72 are depressed are also substantially the same, so there is substantially no difference between the respective operational loads when the portions A and C of the pushbutton 72 are depressed.

Further, comparison of the respective operational loads when the portions B and A (or C) of the pushbutton 72 are depressed shows that there is no significant difference between the respective reaction forces received by the operating member 68 when the portions B and A (or C) of the pushbutton 72 are depressed, so the difference between the respective operational loads when the portions B and A (or C) of the push button 72 are depressed is small, and the difference in operational load is not so large as that when, as in the prior art, the number of fulcrums at the time of operation of the pushbutton is one and a portion near the fulcrum and a portion far therefrom are depressed. Thus, the respective operational loads when the portions B and A (or C) of the pushbutton 72 are depressed are not so large as to cause the user to experience discomfort, and are substantially of the same magnitude.

When a portion E on the rear side of the central portion B of the pushbutton 72 shown in FIG. 2 is depressed, depressing force is applied to the portion of the operating member 68 near the rear end portion thereof; while the two springs 70 upwardly urging the operating member 68 are compressed in the same way, due to the depression of the portion of the operating member 68 near the rear end portion thereof, the rear end portion of the operating member 68 moves downwards against the force of the two springs 70 using the front side ones of the engagement portions of the engagement claws 68*c* and the engagement protrusions 50*d*, that is, the above-mentioned portions P2, P4 as fulcrums.

Due to the downward movement of the rear end portion of the operating member 68, at least the abutment portion on the rear side of the operating member 68 abuts the abutment members 62*c* of the depressing member 62, or both abutment portions thereof abut the two abutment members 62*c* to transmit the depressing force to the depressing member 62, whereby the depressing member 62 is depressed, and the right-hand end portion of the depressing member 62 moves downwards using the lock portions of the two lock claws 62*b* as fulcrums, with the switch member of the tact switch 60 being depressed through the rubber 64 to turn on the tact switch 60.

When a portion H on the front side of the central portion B of the pushbutton 72 shown in FIG. 2 is depressed, depressing force is applied to the portion of the operating member 68 near the front end portion thereof; while the two springs 70 upwardly urging the operating member 68 are compressed in the same way, due to the depression of the portion of the operating member 68 near the front end portion thereof, the front end portion of the operating member 68 moves downwards against the force of the two springs 70 using the rear side ones of the engagement portions of the engagement claws 68*c* and the engagement protrusions 50*d*, that is, the above-mentioned portions P1, P3, as fulcrums.

Due to the downward movement of the front end portion of the operating member 68, at least the abutment portion on the front side of the operating member 68 abuts the abutment members 62*c* of the depressing member 62, or both abutment portions thereof abut the two abutment members 62*c* to transmit the depressing force to the depressing member 62, whereby the depressing member 62 is depressed, and the right-hand end portion of the depressing member 62 moves downwards using the locked portions of the two lock claws 62*b* as fulcrums, with the switch member of the tact switch 60 being depressed through the rubber 64 to turn on the tact switch 60.

Here, the respective operational loads when the portions E and H of the pushbutton 72 are depressed will be compared with each other. The distance from the portion E, which is the depressed portion, to the fulcrums P2, P4, is substantially the same as the distance from the portion H, which is the depressed portion, to the fulcrums P1, P3, and the respective reaction forces received by the operating-member 68 when the portions E and H of the pushbutton 72 are depressed are also substantially the same, so there is substantially no difference between the respective operational loads when the portions E and H of the pushbutton 72 are depressed.

Further, comparison of the respective operational loads when the portions B and E (or H) of the pushbutton 72 are depressed shows that there is no significant difference between the respective reaction forces received by the operating member 68 when the portions B and E (or H) of the pushbutton 72 are depressed, so the difference between the respective operational loads when the portions B and E (or H) of the pushbutton 72 are depressed is small, and the difference in operational load is not so large as that when, as in the prior art, the number of fulcrums at the time of operation of the pushbutton is one and a portion near the fulcrum and a portion far therefrom are depressed. Thus, the respective operational loads when the portions B and E (or H) of the pushbutton 72 are depressed are not so large as to cause the user to experience discomfort, and are substantially of the same magnitude.

<Corner Depressing Operation>

When a portion D, which is on the left rear side of the pushbutton shown in FIG. 2, is depressed, the depressing force on the pushbutton 72 is applied to the portion of the operating member 68 near the left rear end portion thereof, so, of the two springs upwardly urging the operating member 68, the left-hand spring is compressed harder than the right-hand spring 70, and the left-hand end portion, mainly the left rear end portion, of the operating member 68 moves downwards against the force of the two springs 70 using the engagement portion P2 of the right front side engagement claws 68*c* and the engagement protrusions 50*d* corresponding thereto as a fulcrum.

When a portion F, which is on the right rear side of the pushbutton 72 shown in FIG. 2, is depressed, the depressing force on the pushbutton 72 is applied to the portion of the operating member 68 near the right rear end portion thereof, so, of the two springs 70 upwardly urging the operating member 68, the right-hand spring 70 is compressed harder than the left-hand spring 70, and the right-hand end portion, mainly the right rear end portion, of the operating member 68 moves downwards against the force of the two springs 70 using the engagement portion P4 of the left front side engagement claws 68*c* and the engagement protrusions 50*d* corresponding thereto as a fulcrum.

When a portion G, which is on the left front side of the pushbutton 72 shown in FIG. 2, is depressed, the depressing force on the pushbutton 72 is applied to the portion of the operating member 68 near the left front end portion thereof, so, of the two springs 70 upwardly urging the operating member 68, the left-hand spring 70 is compressed harder than the right-hand spring 70, and the left-hand end portion, mainly the left front end portion, of the operating member 68 moves downwards against the force of the two springs 70 using the engagement portion P1 of the right rear side engagement claws 68*c* and the engagement protrusions 50*d* corresponding thereto as a fulcrum.

When a portion I, which is on the right front side of the pushbutton 72 shown in FIG. 2, is depressed, the depressing force on the pushbutton 72 is applied to the portion of the operating member 68 near the right front end portion thereof, so, of the two springs 70 upwardly urging the operating member 68, the right-hand spring 70 is compressed harder than the left-hand spring 70, and the right-hand end portion, mainly the right front end portion, of the operating member 68 moves downwards against the force of the two springs 70 using the engagement portion P3 of the left rear side engagement claws 68*c* and the engagement protrusions 50*d* corresponding thereto as a fulcrum.

As a result of the downward movement of the left-hand end portion of the operating member 68, the abutment portions of the operating member 68 abut the abutment members 62*c* of the depressing member 62 to transmit the depressing force to the depressing member 62, whereby the depressing member 62 is depressed, with the right-hand end portion of the depressing member 62 being moved downwards using the locked portions of the lock claws 62*b* as fulcrums to depress the switch member of the tact switch 60 through the rubber 64 to thereby turn on the tact switch 60.

Here, the respective operational loads when the portions D and F of the pushbutton 72 are depressed will be compared with each other. The distance from the portion D, which is the depressed portion, to the fulcrum P2 is substantially the same as the distance from the portion F, which is the depressed portion, to the fulcrum P4, and the respective reaction forces received by the operating member 68 when the portions D and F of the pushbutton 72 are depressed are substantially the same. Accordingly, there is substantially no difference between the respective operational loads when the portions D and F of the pushbutton 72 are depressed.

Further, comparison of the respective operational loads when the portions B and D (or F) of the pushbutton 72 are depressed shows that there is no significant difference between the respective reaction forces received by the operating member 68 when the portions B and D (or F) of the pushbutton 72 are depressed, so the difference between the respective operational loads when the portions B and D (or F) of the push button 72 are depressed is small, and the difference in operational load is not so large as that when, as in the prior art, the number of fulcrums at the time of operation of the pushbutton is one and a portion near the fulcrum and a portion far therefrom are depressed. Thus, the respective operational loads when the portions B and D (or F) of the pushbutton 72 are depressed are not so large as to cause the user to experience discomfort, and are substantially of the same magnitude.

The respective operational loads when the portions G and I of the pushbutton 72 are depressed are substantially the same for the same reason as when the portions D and F of the pushbutton 72 are respectively depressed. As to the difference between the respective operational loads when the portions B and G (or I) of the pushbutton 72 are depressed, it does not become so large as to cause the user to experience discomfort and the two operational loads are substantially of the same magnitude for the same reason as when the portions B and D (or F) of the pushbutton 72 are depressed.

Thus, according to the above-mentioned embodiment, when depressing a portion of the pushbutton 72 other than the center thereof, i.e., an end portion or a corner portion thereof, the distance between the depressed portion of the pushbutton 72, that is, the depressed portion of the operating member 68, and the fulcrum at the time of the corresponding downward movement of the operating member 68 is substantially the same, making it possible to make the operational load substantially uniform regardless of the portion depressed of the operating member 68.

Further, due to the construction in which the fulcrums P1 and P2 are arranged on the right-hand side and in which the fulcrums P3 and P4 are arranged on the left-hand side, with the right-hand spring 70 being arranged between the fulcrums P1 and P2 and the left-hand spring 70 being arranged between the fulcrums P1 and P2, it is possible for the operating member 68 to make a downward rotation (downward movement) using a proper fulcrum according to the depressed portion of the operating member 68 (the depressed portion of the pushbutton 72), making it possible to secure uniformity in terms of operational load.

Further, the intermediate portion between the locked portions of the lock claws 62*b* of the depressing member 62, the center of the tact switch 60, and the center of the switch case 50 are arranged in the same row as seen in plan view, so when the depressing member 62 is depressed through depression of the operating member 68, with the operating member 68 being in contact with substantially the central portion of the depressing member 62, the moment of the depressing member 62 at the time of depression of the tact switch 60 by the depressing member 62 is substantially the same regardless of the portion depressed of the operating member 68 (the depressed portion of the pushbutton 72), making it possible to secure uniformity in terms of operational load.

Modification Example

Figure 11:
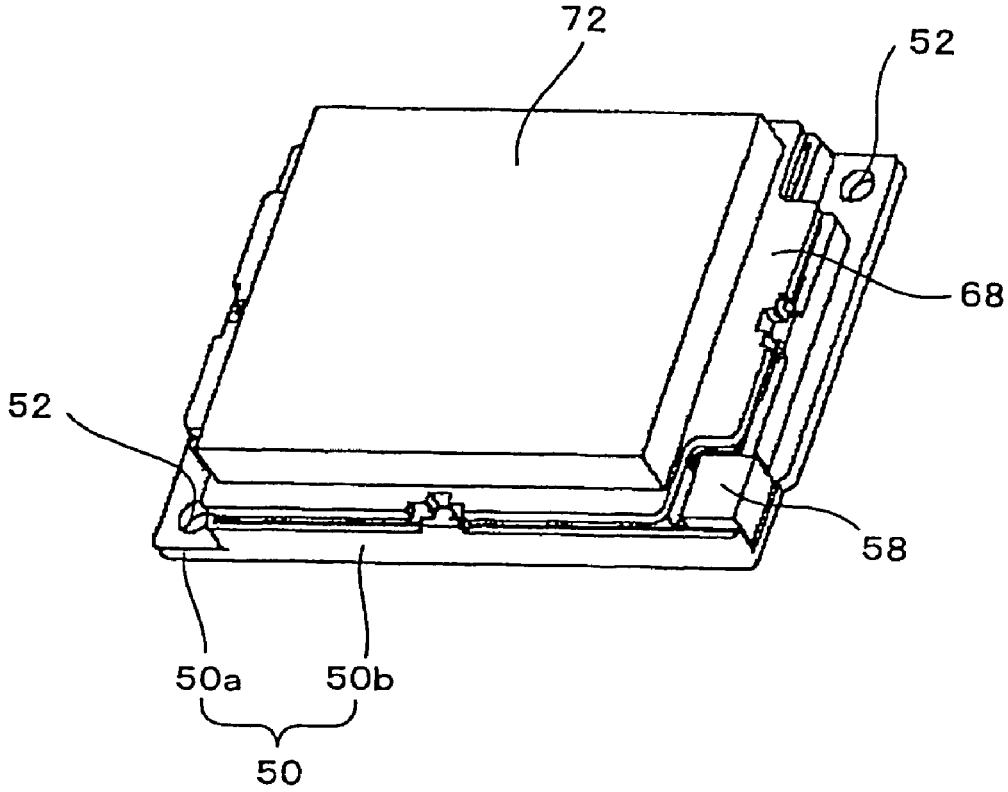
FIG. 11 is an external perspective view of a modification example.
Figure 12:
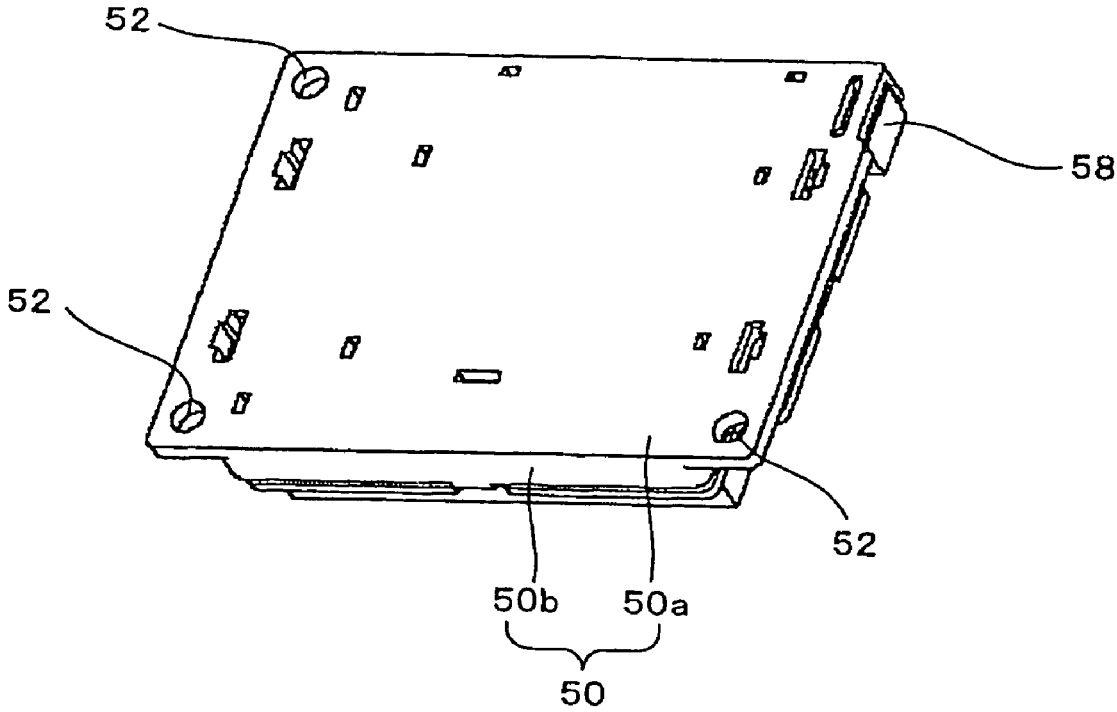
FIG. 12 is a bottom perspective view of the modification example.
Figure 13:
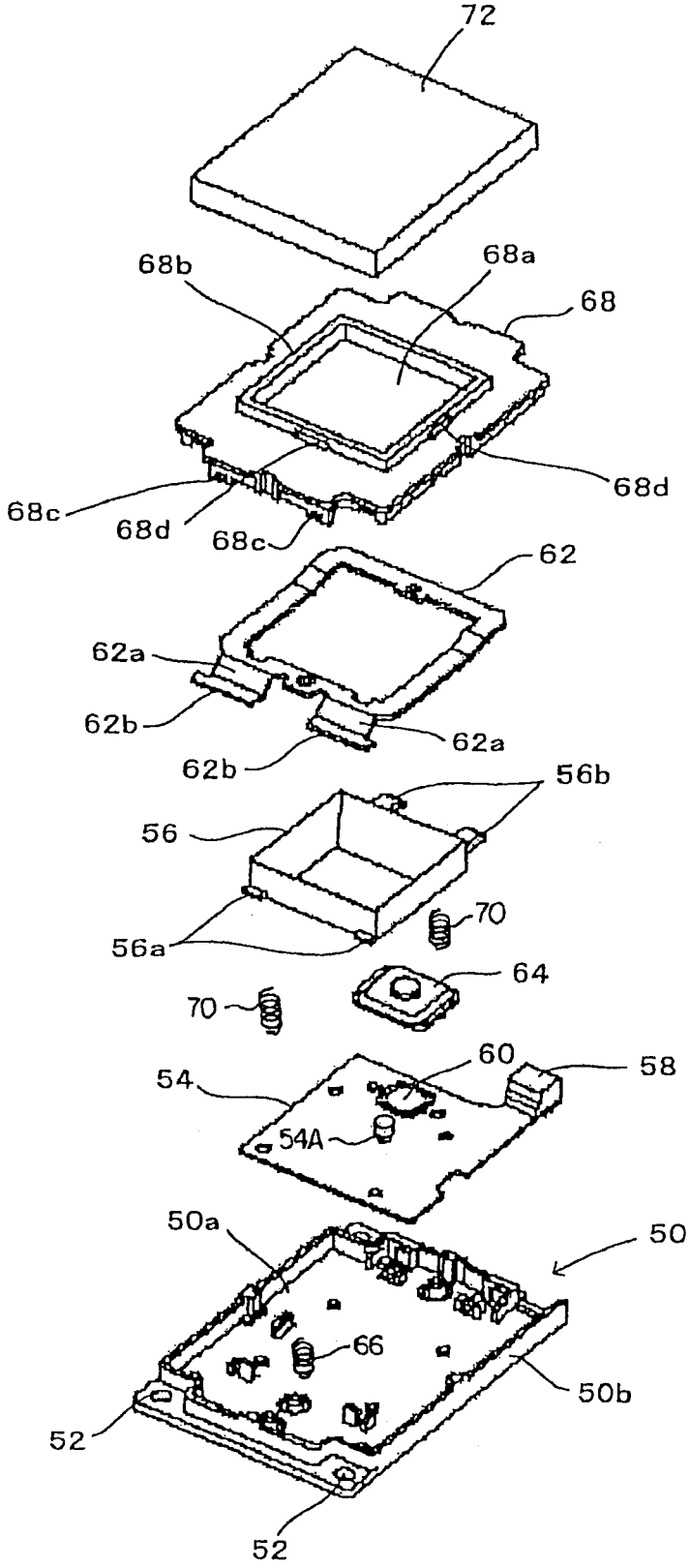
FIG. 13 is an exploded perspective view of the modification example as seen obliquely from above.
Figure 14:
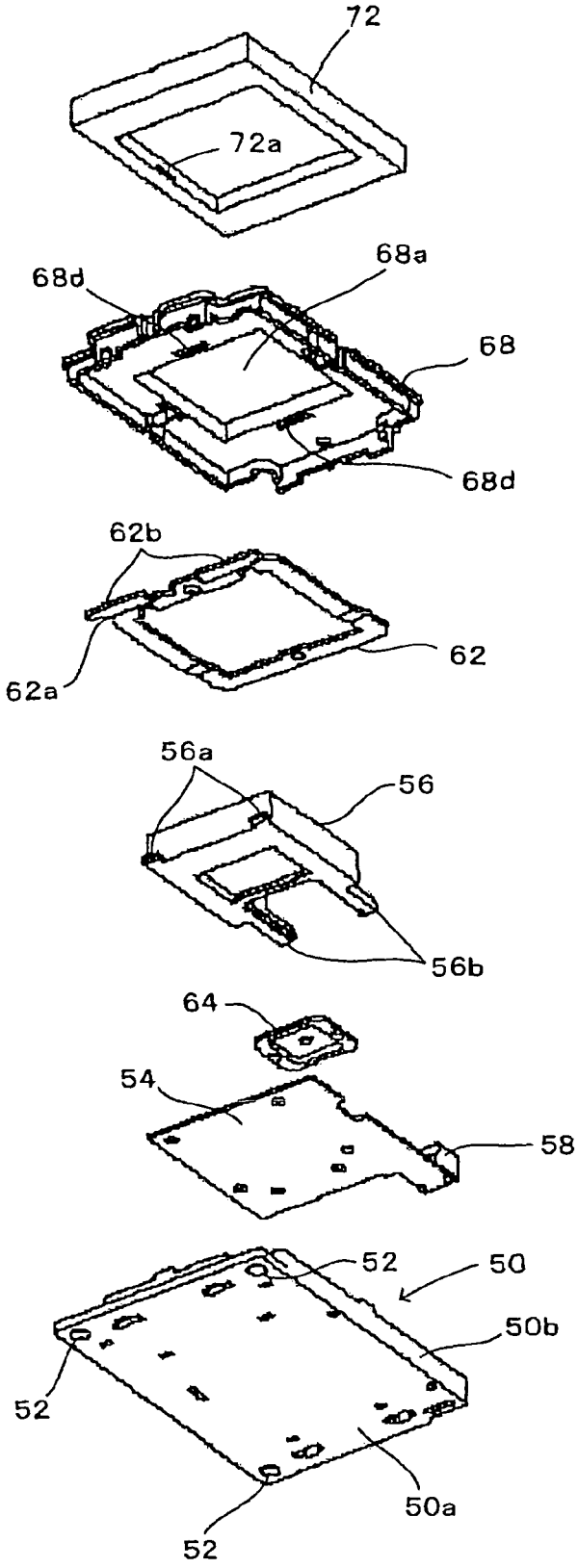
FIG. 14 is an exploded perspective view of the modification example as seen obliquely from below.
Figure 15:
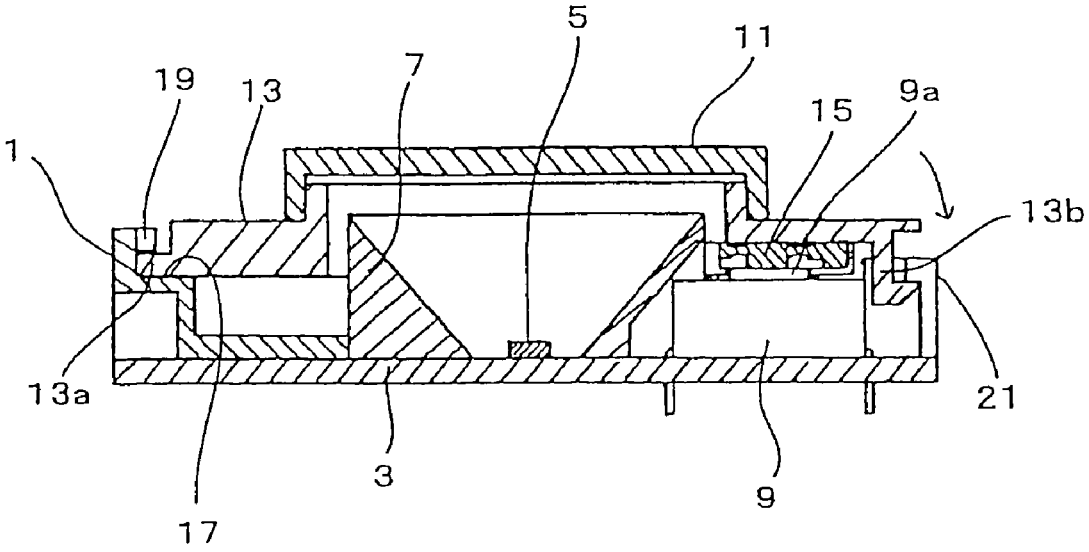
FIG. 15 is a sectional view of a conventional example.

Next, FIGS. 11 through 14 show a modification example of the above-mentioned embodiment, of which FIG. 11 is an external perspective view, FIG. 12 is a bottom perspective view, FIG. 13 is an exploded perspective view as seen obliquely from above, and FIG. 14 is an exploded perspective view as seen obliquely from below. In FIGS. 11 through 14, the components that are the same as or equivalent to those of FIGS. 1 through 10 are indicated by the same reference symbols.

The basic construction of the pushbutton switch device of this modification example is substantially the same as that of the above-mentioned embodiment, and differs therefrom in that the abutment members 62*c* of the depressing member 62 are eliminated, and that abutment portions on the front and rear lower surfaces of the operating member 68 are respectively brought into direct contact with the respective centers of the front and rear end portions of the depressing member 62 to thereby depress the depressing member 62.

Due to the elimination of the abutment members 62*c* of the depressing member 62, it is possible to achieve a reduction in size of the depressing member 62, thus making it possible to achieve a reduction in size of the switch device as a whole.

The present invention is not restricted to the above-mentioned embodiment but allows various modification examples without departing from the gist thereof.

For example, while in the above-mentioned embodiment, the switch case 50, the depressing member 62, and the operating member 68 are rectangular in plan view, they may also be of some other symmetrical configuration, such as a circular configuration; in this case also, it is possible to obtain the same effect as that of the above-mentioned embodiment.

Further, while in the above-mentioned embodiment, the pushbutton 72 is detachably attached to the operating member 68, it is also possible for the operating member 68 to be integrated with the pushbutton 72.

Further, it is not always necessary for the pushbutton switch device to have a built-in light emitting element, such as an LED or a lamp. The switch arranged in the switch case 50 is not restricted to the tact switch 60, either.

Further, while the above-mentioned embodiment is equipped with the spring 66 for adjusting the urging force of the depressing member 62, there is no need to provide the spring 66 depending upon the urging force, and it may be eliminated.

According to the present invention, when the operating member is depressed, the operating member abuts substantially the center of the upper surface of the depressing member, and the depressing member is moved downwards against the upward urging force. Here, at the time of depression of the operating member, the depressed portion of the operating member rotates downwardly using as a fulcrum the engagement portion corresponding to the depressed portion of the operating member.

Thus, the fulcrum is switched according to the depressed portion of the operating member, so, no matter which portion of the operating member may be depressed, the distance between the depressed portion and the fulcrum is the same. Unlike the case in which a single fixed fulcrum is used as in the prior art, it is possible to make the operational load substantially uniform regardless of the portion depressed of the operating member.

If, at this time, the depressing member is urged by an urging member, it is possible to adjust the operational load through upward urging by the urging member.

Further, the depressing member itself may be formed of an elastic member, so, as compared with the case in which the urging is effected by an urging member, it is possible to reduce the number of parts, making it possible to achieve a reduction in cost.

Further, since the operating member is upwardly urged, it is possible to reduce variation in the load on the depressed portion of the operating member.

Further, by urging the depressing member by an urging member, it is possible to adjust the operational load, and, by urging the operating member by another urging member, it is possible to reduce variation in the load on the depressed portion of the operating member.

Further, since the depressing member itself is formed of an elastic member, and is urged by an urging member, it is possible to adjust the operational load. On the other hand, since the operating member is urged by another urging member, it is possible to reduce variation in the load on the depressed portion of the operating member.

Further, the lock portion at one end of the depressing member, the center of the switch, and the center of the switch case are arranged in the same row as seen in plan view, so when the depressing member is depressed by bringing the operating member into contact with substantially the central portion of the depressing member through depression of the operating member, the moment at the time of depression of the switch by the depressing member is substantially fixed regardless of the operated portion of the operating member, making it possible to secure uniformity in operational load.

Further, the plurality of engagement portions of the operating member are formed at opposing positions in the peripheral edge of the operating member, so it is possible to make the distance between the depressed portion of the operating member and the fulcrum substantially the same regardless of the portion depressed, making it possible to secure uniformity in terms of operational load.

Further, a part of the engagement portions of the operating member are formed on the same side as one end portion of the locked depressing member, and the remainder of the engagement portions of the operating member are formed on the opposite side, so it is possible to make the distance between the depressed portion of the operating member and the fulcrum substantially the same regardless of the portion depressed, making it possible to secure uniformity in terms of operational load.

Further, since the depressing member and the operating member are formed in a substantially symmetrical configuration, such as a rectangular or a circular configuration, it is possible to easily secure the uniformity in the distance between the depressed portion of the operating member and the fulcrum, which is useful in securing uniformity in operational load.

INDUSTRIAL APPLICABILITY

The pushbutton switch according to the present invention is not restricted to a switch for an elevator as in the case of the above-mentioned embodiment. It is also applicable, in particular, to various switches for electronic apparatuses having a built-in light emitting element and adapted to supply information on whether switch operation has been conducted or not through the light emitting state, as in the case of a so-called start switch of a copying machine.

The invention claimed is:

1. A pushbutton switch device comprising:

a switch case;

a switch arranged in the switch case and deviated from a central portion of the switch case toward an end portion side of the switch case;

a depressing member, in the form of a unbroken band, which is arranged in the switch case and has a locked portion, the locked portion being formed on one side of the depressing member and locked to the switch case, the depressing member being vertically movable using the locked portion as a fulcrum and urged upwardly, wherein the depressing member depresses the switch when moved downwards; and an operating member which is arranged above the depressing member in the switch case so as to be vertically movable by external pressure, a central portion of the operating member being surrounded by the depressing member, the operating member having a main portion, a plurality of engagement portions engaged with a peripheral edge of the switch case so as not to be detached from the switch case, and an abutment portion which, when depressed, comes into contact with an upper surface of the depressing member to cause the depressing member to move downwardly against an upward urging force, wherein, when the operating member is depressed away from a center of the operating member, a depressed portion of the operating member rotates downwardly using, as a fulcrum, at least one of the engagement portions of the plurality of engagement portions located opposite to the depressed portion.

2. The pushbutton switch device according to claim 1, wherein the depressing member is urged by a first urging member.

3. The pushbutton switch device according to claim 1, wherein the operating member is urged upwardly by an urging member.

4. The pushbutton switch device according to claim 1, wherein the depressing member is urged by a first urging member; and the operating member is urged upwardly by a second urging member.

5. The pushbutton switch device according to claim 1, wherein the plurality of engagement portions are outwardly directed from a bottom surface of the main portion of the operating member.

6. The pushbutton switch device according to claim 1, wherein the depressing member is formed of an elastic member; and an end of the depressing member is locked to the switch case to impart an urging force to an opposite end of the depressing member.

7. The pushbutton switch device according to claim 6, wherein the end of the depressing member locked to the switch case, the center of the switch, and the center of the switch case are arranged in a row.

8. The pushbutton switch device according to claim 1, wherein the depressing member is formed of an elastic member, the depressing member is locked to the switch case at one end of the depressing member to impart an urging force to the other end of the depressing member, and is urged by a first urging member; and the operating member is upwardly urged by a second urging member.

9. The pushbutton switch device according to claim 8, wherein the end of the depressing member locked to the switch case, the center of the switch, and the center of the switch case are arranged in a row.

10. The pushbutton switch device according to claim 1, wherein the plurality of engagement portions of the operating member are formed at opposing positions along a bottom surface of a peripheral edge of the main portion of the operating member.

11. The pushbutton switch device according to claim 10, wherein a first pair of the engagement portions of the plurality of engagement portions of the operating member are formed on the same side as an end of the depressing member locked to the switch case; and a second pair of the engagement portions of the plurality of engagement portions of the operating member are formed on the opposite side of the locked portion of the depressing member.

12. The pushbutton switch device according to claim 1, wherein the depressing member and the operating member are formed in a substantially symmetrical configuration.

13. The pushbutton switch device according to claim 12, wherein the depressing member and the operating member are formed in a rectangular configuration.

* * * * *